US006050252A

United States Patent [19]

Etheridge

[11] Patent Number: 6,050,252

[45] Date of Patent: Apr. 18, 2000

[54] CAMOFLAUGE FLETCHING COVER AND PROTECTOR FOR A BOW

[76] Inventor: Herbert Fay Etheridge, 1539 Oak Grove Rd., Red Boiling Springs, Tenn. 37150

[21] Appl. No.: 09/002,632

[22] Filed: Jan. 5, 1998

[51] Int. Cl.[7] ..... F41B 5/06

[52] U.S. Cl. ..... 124/86; 124/25.5; 150/154

[58] Field of Search ..... 124/25.5, 25.7, 124/86, 90; 150/154, 155, 160, 163; 224/916

[56] References Cited

U.S. PATENT DOCUMENTS

| | | | |
|---|---|---|---|
| 1,633,988 | 6/1927 | Jones | 150/155 |
| 1,957,577 | 5/1934 | Chapman | 150/60 |
| 2,768,669 | 10/1956 | Kinnee | 124/25.7 X |
| 2,897,864 | 8/1959 | Schmidt | 124/25.7 X |
| 2,984,277 | 5/1961 | Neff | 124/25.7 X |
| 3,465,928 | 9/1969 | Osterholm | 124/25.7 X |
| 3,696,978 | 10/1972 | Gentellalli | 124/25.7 X |
| 3,766,954 | 10/1973 | Gentellalli | 224/916 X |
| 4,785,934 | 11/1988 | Hogle | 150/154 X |
| 4,955,473 | 9/1990 | VanHout et al. | 224/916 X |

*Primary Examiner*—John A. Ricci
*Attorney, Agent, or Firm*—Rick R. Wascher

[57] ABSTRACT

A fletching cover for arrows having a flexible body having an exterior surface, a rim forming a main opening which is sized to receive the fletching of an arrow, and a pocket which is in communication with the main opening formed by the rim enabling the flexible body to cover the fletching of the arrow.

8 Claims, 3 Drawing Sheets

FIG. 2
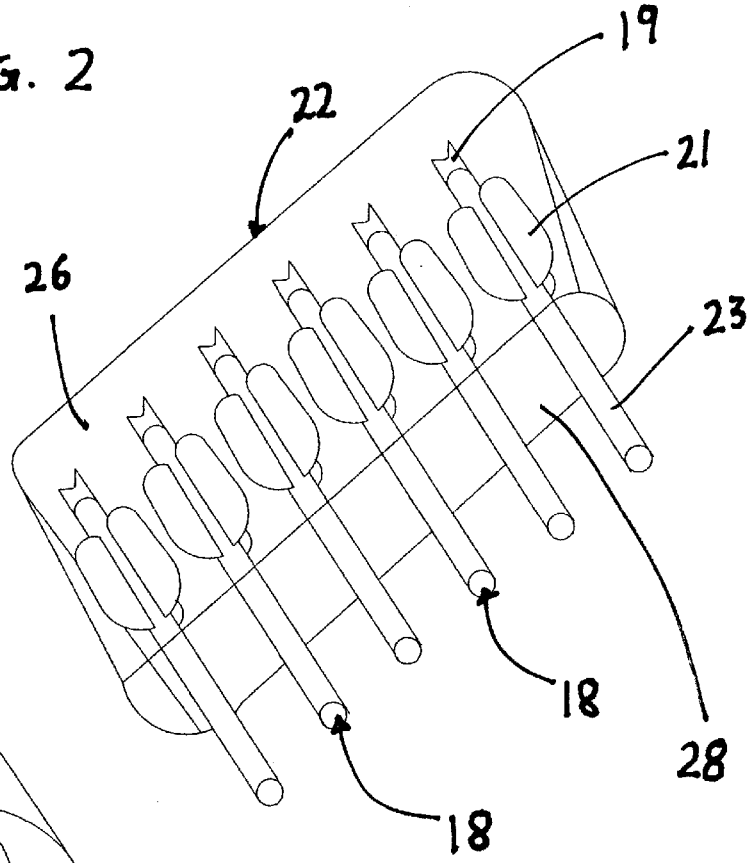
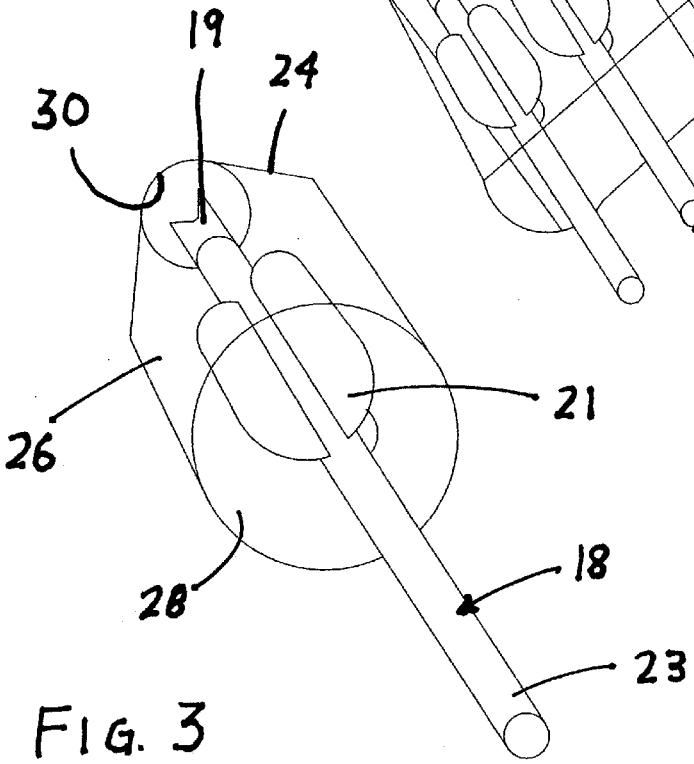
FIG. 3

CAMOFLAUGE FLETCHING COVER AND PROTECTOR FOR A BOW

BACKGROUND OF THE INVENTION

1. Field of the Invention

The present invention relates generally to camoflauge covers for hunting bows that shoot arrows, but more particularly to such covering devices that are configured and placed in use to mask the color of the bow or its components such as the feathers of "fletching" of the arrow to enable the hunter to minimize detection by the game he is hunting such as, but not limited to, white tailed deer.

2. Description of the Related Art

The art to which the invention relates includes numerous camoflauge covering of a variety of configurations. None of the know devices are designed for use with a bow having a permanent or detachable quiver for holding a supply of arrows in close relationship to the bow itself. Furthermore, none of the known devices are designed or configured to cover the fletching portion of the arrows while resting inside the quiver or while they are placed in a firing position on the bow by the hunter.

The art to which the invention relates includes the following U.S. patents, all of which are incorporated by reference as if fully set forth herein.

U.S. Pat. No. 3,899,620 granted to Roeloffien is directed to camouflage netting having non-woven vegetable fibers.

U.S. Pat. No. 4,375,488 granted to Hogan is directed to a camouflage material for concealing personnel and equipment from people or animals.

U.S. Pat. No. 4,671,988 granted to Dowell et al. is directed to camouflage knitted article in the nature of a camouflage fabric.

U.S. Pat. No. 4,817,579 granted to Mathias is directed to a camouflage shield for archers and is used for disguising or concealing an archer and a hunting bow. The Mathias device is used as a screen-like apparatus and may attach to a bow for such concealment.

U.S. Pat. No. 4,868,019 granted to Knickerbocker is directed to a camouflage system and material for concealing people and objects from animals.

U.S. Pat. No. 5,062,234 granted to Green is directed to a portable blind using camouflage for concealment of the user.

U.S. Pat. No. 5,127,180 granted to Norton et al. is directed to a camouflage device for archery bow and is also in the nature of a extendable screen for use as a device to conceal the archer.

U.S. Pat. No. 5,235,772 granted to Mendick, Jr. is directed to a camouflage for bow hunters and is a screen like device which attaches to the bow for concealing the archer during use.

U.S. Pat. No. 5,348,789 granted to Hellwig is directed to a camouflage net of a flame retardant material.

U.S. Pat. No. 5,409,760 granted to Neitz et al. is directed to a camouflage materials for reducing visual detection by deer and other dichromatic animals.

U.S. Pat. No. 5,445,863 granted to Slagle et al. is directed to camouflage material for use as camouflage sheeting for concealment of people and articles.

U.S. Pat. No. 5,486,384 granted to Bylund et al. is directed to a melted and delustered fabric for use as a camouflage material.

U.S. Pat. No. 5,492,748 granted to Thuswalder et al. is directed to a camouflage netting material for concealing personnel and equipment from people or animals.

U.S. Pat. No. 5,549,938 granted to Nesbitt is directed to removable camouflage for a vehicle.

SUMMARY OF THE INVENTION

Some of the various embodiments of the present invention are shown in the drawings and can be summarized as particularly useful with a bow frame having a bow string 12 capable of firing arrows from the bow frame, and such other optional components such as a sight, stabilizer, and quiver. Virtually every arrow used with a bow includes a nock portion which engages the bow string before the string propels the arrow, a feather or plastic vane portion referred to as the fletching, and of course the arrow head portion.

The embodiments of the present invention include multiple fletching embodiments which protect and cover a portion of a plurality of arrows, and a single fletching embodiment which protects and covers the fletching of a single arrow.

The multiple and single embodiments include a cover body which is preferably made of a soft pliable material such as fleece, jersey or cotton sheeting material in order to minimize noise generated by wind ruffling the material or the hunter brushing against it during the hunt.

The cover bodies also preferably include a camoflauge print exterior of any suitable design or commercial design in order to make the covers seemingly undetectable or invisible to the game being hunted. The body portion of both the multiple cover and single cover is similar to a pocket of material or sheath and includes an opening to receive the fletching portion of the arrow(s). It is well known that many hunters prefer brightly colored or fluorescent arrow fletching for their hunting arrows, and still other prefer natural bird feather fletching. The brightly colored or fluorescent fletching makes the arrows easier to find in the woods after a missed shot or most preferably after the arrow passes completely through the animals body being hunted (e.g., a broadside double lung shot). However, animals such as white tailed deer have keen eyesight and readily see such bright or fluorescent colors and thus the camoflauge covering(s) of the present invention are designed to effectively hide the brightly colored fletching all times prior to the shot by the hunter.

Feather fletching is easily damaged by "ruffling the feathers". In either situation, bright or feather fletching the covers of the present invention protect the fletching from harmful or abrasive contact that might damage the fletching and cause the arrow to fly erratically.

The multiple cover embodiment preferably includes an optional elastic rim portion which enables the opening of the cover body to be stretched over a plurality of arrows and remain snugly positioned thereon during use. Of course, other suitable means of closure for the rim may be used such as, but not limited to, a drawstring closure, hook and loop fasteners, buttons or snaps, etc.

The single cover embodiment also preferably includes a nock hole. The nock hole allows the nock portion of the arrow to protrude therefrom and engage the bowstring during use. This nock hole design of the single cover provides a "shoot through" structure such that the body of the cover, which may be attached to the bowstring and remain there after the arrow is released allows for repeated proper positioning of the arrow for each subsequent shot. The single cover can be attached by an available means such as by tying it or sewing it to the bow string.

The present invention may be summary in a variety of ways, one of which is the following: a fletching cover comprising a flexible body having an exterior surface, a rim forming a main opening which is sized to receive the fletching of an arrow, and a pocket which is in communication with the main opening formed by the rim enabling the flexible body to cover the fletching of the arrow.

An embodiment of the fletching cover further comprises a nock receiving opening opposite the main opening, wherein the nock receiving opening further is also configured to enable the nock receiving opening to close around the nock portion of an arrow.

The exterior surface of the body preferably includes a camoflauge pattern printed thereon, wherein the camoflauge pattern is preferably selected from the group of camoflauge patterns consisting of MOSSY OAK, REALTREE, ADVANTAGE, PREDATOR, and STEALTH.

The rim preferably farther includes an elastic portion enabling the rim to close around the shaft portion an arrow. A securing member is preferably provided to attach the cover to a bow string, and the body sized to receive a plurality of arrows or a single arrow.

The present invention may also be summarized as follows: A fletching cover comprising:

a body portion made of a flexible material and having a camoflauge exterior surface, an elastic rim defining a main opening, and a pocket for receiving the fletching end of an arrow an allowing the elastic rim to snugly engage at least a portion of the fletching end of the arrow. The fletching cover further preferably includes a securing member provided to attach the cover to a bow string.

BRIEF DESCRIPTION OF THE DRAWINGS

FIG. 2 is an elevated perspective view of the multiple fletching cover portion of the invention disclosed in FIG. 1;

FIG. 3 is an elevated perspective view of a single fletching cover portion of the invention disclosed in FIG. 1;

DETAILED DESCRIPTION OF THE PREFERRED EMBODIMENT(S)

Figure 1:
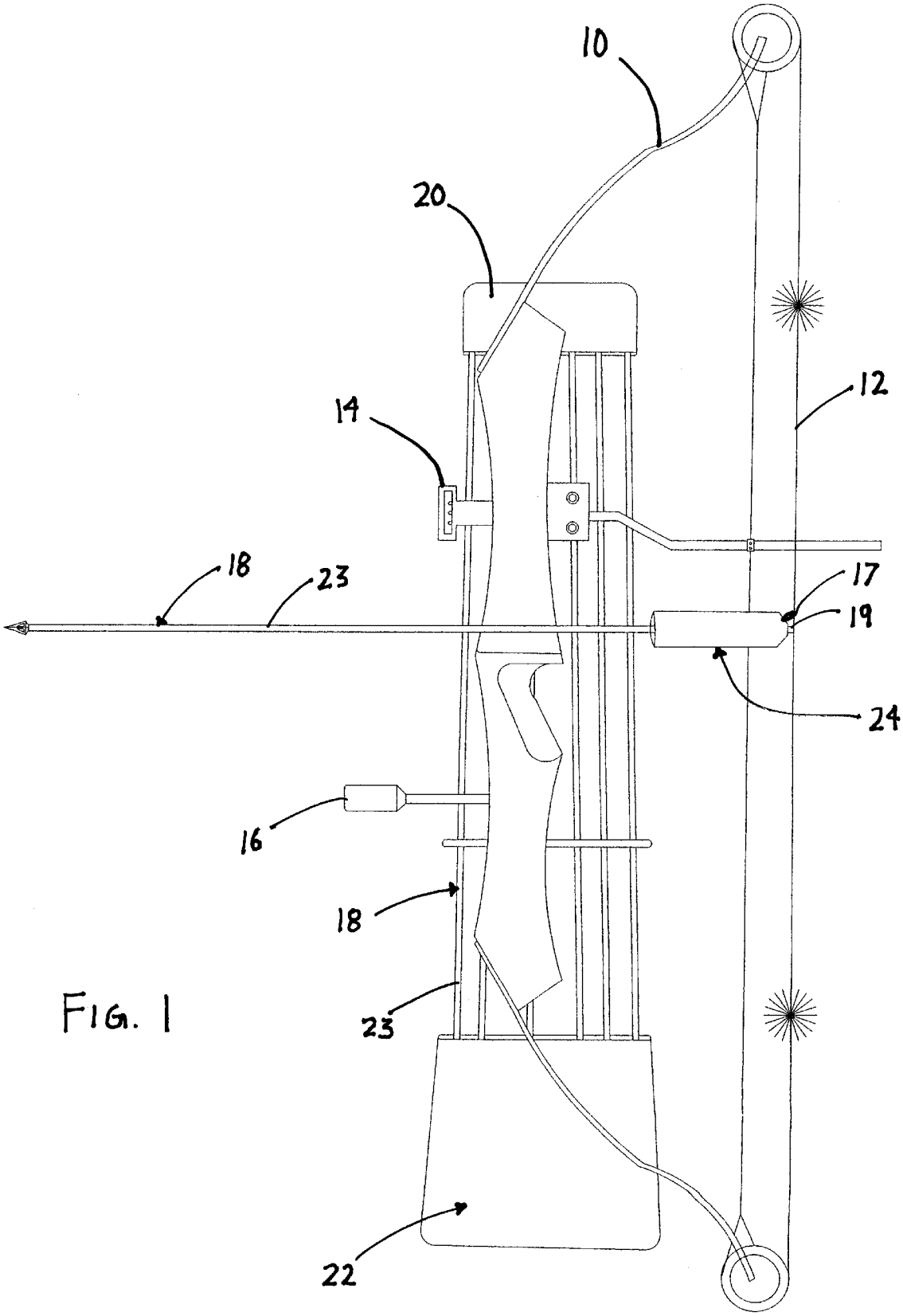
FIG. 1 is an elevated perspective side view of an embodiment of the present invention shown in association with a bow.

With reference to FIG. 1, a bow frame 10 including bow string 12, sight 14, stabilizer 16, arrows 18, and quiver 20 is shown in general orientation with one another. Arrows 18 further include a nock portion 19 and a fletching 21 and shaft 23 (see FIGS. 2 and 3). Of course, other bow geometries and setups are common and may vary, all bows of the type shown in this figure must include a bow frame 10 of some type and a bow string 12 as its minimal essential elements.

The preferred embodiments of the present invention are designated generally by the reference numerals 22 and 24. Multiple fletching cover 22 ("multiple cover") protects and shrouds a plurality of arrows 18 and single fletching cover 24 ("single cover") protects and shrouds the fletching of a single arrow.

With reference to FIGS. 2–5, the multiple cover 22 and single cover 24 include a cover body 28 which is preferably made of a soft pliable quiet fleece or jersey material to minimize noise during use during a hunt. The body 28 also preferably includes a camoflauge print 29 of any suitable design in order to may the covers 22 and 24 invisible to the game being hunted. The body portion 28 of both the multiple cover 22 and single cover 24 is formed like a pocket having an opening 28 to receive the fletching portion 21 of the arrow 18. In this manner, most hunters prefer brightly colored or fluorescent fletching for their hunting arrows. The bright or fluorescent colors make the arrows 18 easier to find in the woods after a missed shot or preferably after the arrow passes completely through and exits the animal being hunted.

It is known that animals such as white tailed deer have keen eyesight and readily see such bright or fluorescent colors and thus a camoflauge covering of the present inventions is provided to hide the brightly colored fletching all times prior to the shot by the hunter.

Figure 4:
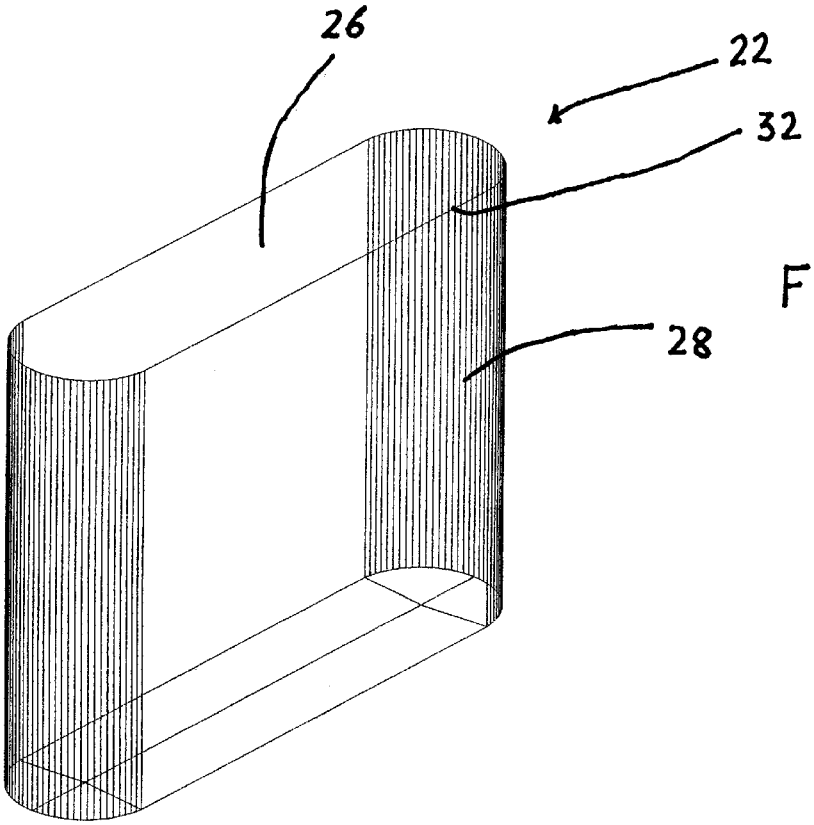
FIG. 4 is an elevated perspective view of the multiple fletching cover portion of the present invention shown in FIG. 2.
Figure 5:
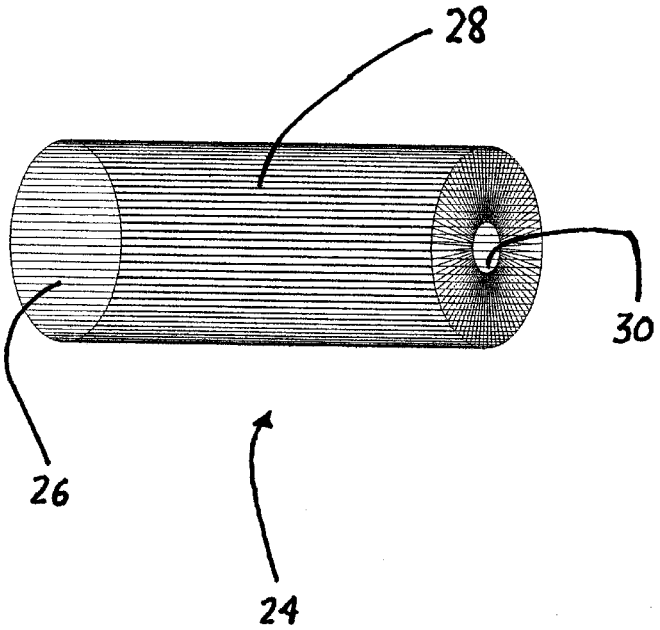
FIG. 5 is an elevated perspective view of the single fletching cover portion of the present invention shown in FIG. 3.

With reference to FIGS. 2 and 4, the multiple cover 22 may also include an elastic rim portion 32 which enables the cover to be stretched over a plurality of arrows 18 and remain snugly positioned thereon during use. With reference to FIGS. 3 and 5, single cover 24 further includes nock hole 30. The nock hole 30 allows the nock portion 19 of the arrow 18 to protrude therefrom and still engage the bowstring 12 (FIG. 1) during use. The design of the single cover 24 provides a "shoot through" structure such that the body 28 of cover 24 remains attached to the bow string 12 (FIG. 1) by a securing member 17 of any conventional means such as by tying the body thereto with string or thread (not shown) at the point where the nock 19 engages the bowstring 12.

These and other embodiments of the present invention shall become apparent after consideration of the disclosure, including the drawings, that are set forth herein. All such alternate embodiments and equivalents are contemplated to be within the scope of the present invention even though not specifically set forth herein.

What is claimed is:

1. A fletching cover in combination with a quiver to conceal a fletching portion of a plurality of arrows, comprising:

a flexible body having an exterior surface, a rim forming a main opening which is sized to receive the fletching of the plurality of arrows, and a pocket which is in communication with the main opening formed by the rim enabling the flexible body to form a sheath and cover the fletching of the plurality of arrows while they are positioned within the quiver in order to hide the fletching from sight at all times prior to the removal of any of the plurality of arrows from the quiver and only after the cover is first removed from the quiver.

2. The fletching cover of claim 1 wherein the exterior surface further includes:

a camoflauge pattern printed thereon.

3. The fletching cover of claim 2, wherein the camouflage pattern is selected from the group of camouflage patterns consisting of:

fall foliage, extra brown, advantage, and breakup.

4. The fletching cover of claim 1 wherein the rim further includes:

an elastic portion enabling the rim to close around the shaft portion of an arrow.

5. A fletching cover in combination with a quiver to conceal a fletching end of a plurality of arrows, comprising:

a body portion made of a flexible material and having a camouflage exterior surface, an elastic rim defining a single opening and a pocket for receiving the fletching end of a plurality of arrows and allowing the elastic rim of the single opening to snugly engage at least a portion of the fletching end of the plurality of arrows as they are supported by and reside within the quiver in order to hide the fletching from sight at all times prior to the removal of any of the plurality of arrows from the quiver and only after the cover is first removed from the quiver.

6. The fletching cover of claim 5, wherein the camouflage pattern is selected from the group of camouflage patterns consisting of:

fall foliage, extra brown, advantage, and breakup.

7. The fletching cover of claim 6 wherein the rim further includes:

an elastic portion enabling the rim to close around the nock portion of an arrow.

8. The fletching cover of claim 5 wherein the rim further includes:

an elastic portion enabling the rim to close around the shaft portion of an arrow.

* * * * *